US007665154B2

(12) United States Patent
Gerstel Costello

(10) Patent No.: US 7,665,154 B2
(45) Date of Patent: Feb. 23, 2010

(54) ADJUSTABLE HEADWEAR WITH INTEGRATED HAIR BAND

(76) Inventor: Michele Gerstel Costello, 495 Van Buren St., Los Altos, CA (US) 94022

( * ) Notice: Subject to any disclaimer, the term of this patent is extended or adjusted under 35 U.S.C. 154(b) by 772 days.

(21) Appl. No.: 11/282,344

(22) Filed: Nov. 17, 2005

(65) Prior Publication Data

US 2007/0118970 A1 May 31, 2007

(51) Int. Cl.
*A41B 1/22* (2006.01)

(52) U.S. Cl. ..... 2/195.2; 2/195.1; 2/195.3; 2/171; 2/209.13

(58) Field of Classification Search ..... 2/195.1, 2/195.2, 195.3, 194.4, 171, 174, 209.4, 209.13, 2/209.7, 209.3, 175.7, 171.4, 183, 195.4
See application file for complete search history.

(56) References Cited

U.S. PATENT DOCUMENTS

| | | | | |
|---|---|---|---|---|
| 4,993,079 | A | 2/1991 | Johnson | |
| 5,450,629 | A * | 9/1995 | Gilstrap | 2/209.11 |
| D365,917 | S * | 1/1996 | Armstrong | D2/881 |
| 5,799,334 | A | 9/1998 | Griffith et al. | |
| 5,933,872 | A * | 8/1999 | Lema | 2/209.7 |
| 6,170,086 | B1 | 1/2001 | Lee | |
| 6,421,838 | B1 * | 7/2002 | Frank | 2/195.3 |
| 6,467,096 | B1 * | 10/2002 | Coluccio | 2/195.2 |
| 6,484,323 | B1 * | 11/2002 | Pu | 2/410 |
| 6,658,664 | B1 | 12/2003 | Verhoeven | |
| 2002/0029404 | A1 * | 3/2002 | Friedman | 2/195.2 |
| 2003/0106134 | A1 * | 6/2003 | Kim | 2/171 |
| 2004/0187191 | A1 | 9/2004 | Lee | |
| 2004/0210985 | A1 | 10/2004 | Lee et al. | |

OTHER PUBLICATIONS

Helen Kaminski Australia, Spring 2004 Catalogue.
Helen Kaminski Australia, Fall 2004 Catalogue.

* cited by examiner

*Primary Examiner*—Gary L Welch
*Assistant Examiner*—Alissa J Tompkins
(74) *Attorney, Agent, or Firm*—Morgan, Lewis & Bockius LLP

(57) ABSTRACT

Adjustable headwear with an integrated flexible cord coupled to the lower crown portion of the headwear. The flexible cord is used to adjust the size of the headwear, and is also used to secure a wearer's hair when the wearer forms their hair into a ponytail. A fastening device clamped to the flexible cord is used to tighten the headwear on the wearer's head.

19 Claims, 7 Drawing Sheets

ADJUSTABLE HEADWEAR WITH INTEGRATED HAIR BAND

TECHNICAL FIELD

The present invention relates to headwear and, in particular, to adjustable headwear with an integrated cord for securing a wearer's ponytail or tresses.

BACKGROUND

Existing headwear is available in a variety of shapes, styles and sizes. Despite manufacturers' attempts to make headwear available in all sizes, manufacturers have yet to find a cost effective or practical means for full customization. Therefore, conventional hats are usually available in three to five preset sizes, such as extra-small, small, medium, large or extra-large, with no means for adjustment. Certain baseball caps are available in preset sizes as well, ranging in size from six to eight and increasing in increments of one centimeter. The result is that many wearers are not able find headwear that fit their heads perfectly.

Typically, baseball caps and visors are one-size-fits-all. These baseball caps usually have an opening in the back that can be modified to a number of preset sizes. This modification may be accomplished, for example, by adjusting and snapping together plastic tabs positioned at the rear of the cap. This method may not always provide a comfortable fit for every wearer's head, as some wearers may need to adjust the cap to a size different from the preset sizes.

Alternative modes of adjusting the size of baseball caps utilize a hook and loop fastener (VELCRO), which also has its drawbacks. In particular, similar to plastic tabs, this fastening method also has a predetermined minimum size. Additionally, this type of fastener allows strands of hair to get caught in the small hooks of the fasteners and often times the VELCRO connection breaks from the stress resulting in an unsecured fit on the head. Furthermore, with both the plastic tab fasteners and the hook and loop fasteners, adjustment is performed to the back portion of the cap only. This causes unsightly extra fabric that bunches up in the back of the headwear.

Furthermore, individuals with long hair may wish to contain their tresses in place, especially when participating in sports and other physical activities or in high wind conditions. Typically, these individuals will gather their hair into a bundle at the back of their head to form a ponytail and secure the hair by twisting an elasticized cord around the base of the ponytail. They then have to fit the secured hair into exactly the right space allocated by the hat, and as such the headwear may interfere with the ponytail or vice versa. Typically, a wearer would have to repeatedly modify the position of their ponytail in order to accommodate the position and structure of the headwear. Additionally, this requires the wearer to use an additional device for securing their hair.

In light of the forgoing, it would be desirable to provide adjustable and customizable headwear to meet the needs of any wearer that has an integrated component for securing a wearer's hair.

SUMMARY

The present invention provides headwear that is fully adjustable and provides a means for securing a wearer's ponytail. The headwear includes an integrated flexible cord, which runs along the entire circumference of the lower crown and is used to adjust the size of the headwear. Therefore, the lower crown is fully adjustable and can be modified to any size, as needed. The integrated flexible cord detaches from the lower crown at the rear of the headwear forming a continuous loop extended from the lower crown. This loop can be twisted around a wearer's ponytail to secure the wearer's hair in place. The flexible cord is also extendible at a position remote from the continuous loop, where, in some embodiments, it forms first and second ends. These ends are coupled together by a fastening device. The fastening device is slidable and clamps the cord near its two ends together. The closer the fastener is pulled towards the wearer's head, the tighter the hat fits. Unlike other headwear, the integrated flexible cord and adjustment mechanism of this headwear provides full adjustability. The headwear can be modified to an infinite number of sizes as there are no preset sizes already established. Additionally, the integrated flexible cord of the headwear allows a wearer to secure their hair without the use of additional devices.

According to some embodiments, there is provided, adjustable headwear that includes a lower crown with a predetermined diameter. The head wear also includes a cord that runs along the lower crown and forms a loop extended from the lower crown. This loop is of sufficient length to wrap around a wearer's ponytail. The cord of the headwear also has a tightening portion extended from the lower crown at a position remote from the loop. This tightening portion is used to tighten the loop and reduce the diameter of the lower crown.

According to other embodiments, there is provided, adjustable headwear that includes a lower crown with a brim that runs along the lower crown. The headwear also includes a cord that also runs along the lower crown and above the brim and is extendible to form a continuous loop extended from the lower crown. This loop is of sufficient length to wrap around a wearer's ponytail. The cord is also extendible to form a second extended end at a remote position from the first loop. The headwear also includes a passageway around the crown of sufficient size to allow the cord to pass through and has an opening at the front of the crown of sufficient size to allow access to the cord.

According to other embodiments, there is provided, a method of adjusting headwear that includes a lower crown with a predetermined diameter and a cord that runs along the lower crown. The cord includes a loop extended from the lower crown and a tightening portion extended from the lower crown at a position remote from the loop. The method of adjusting the headwear is accomplished by first positioning the headwear on a wearer's head. Then, the loop is twisted around the wearer's ponytail. The cord is extended at a position remote from the loop to tighten the loop around the ponytail, reduce the diameter of the lower crown, and secure the tightening portion.

According to other embodiments, there is provided, adjustable headwear that includes a contacting means for contacting a wearer's head. The headwear has a predetermined diameter. The headwear includes a means for adjustment that slides along at least part of the contact means. This means for adjustment includes a means for loop wrapping around a wearer's ponytail, which is extended from the contact means and a means for tightening the loop and reducing the diameter of the contact means. The means for tightening the loop is extended from the contact means at a position remote from the means for wrapping.

DETAILED DESCRIPTION OF THE EMBODIMENTS

Figure 1:
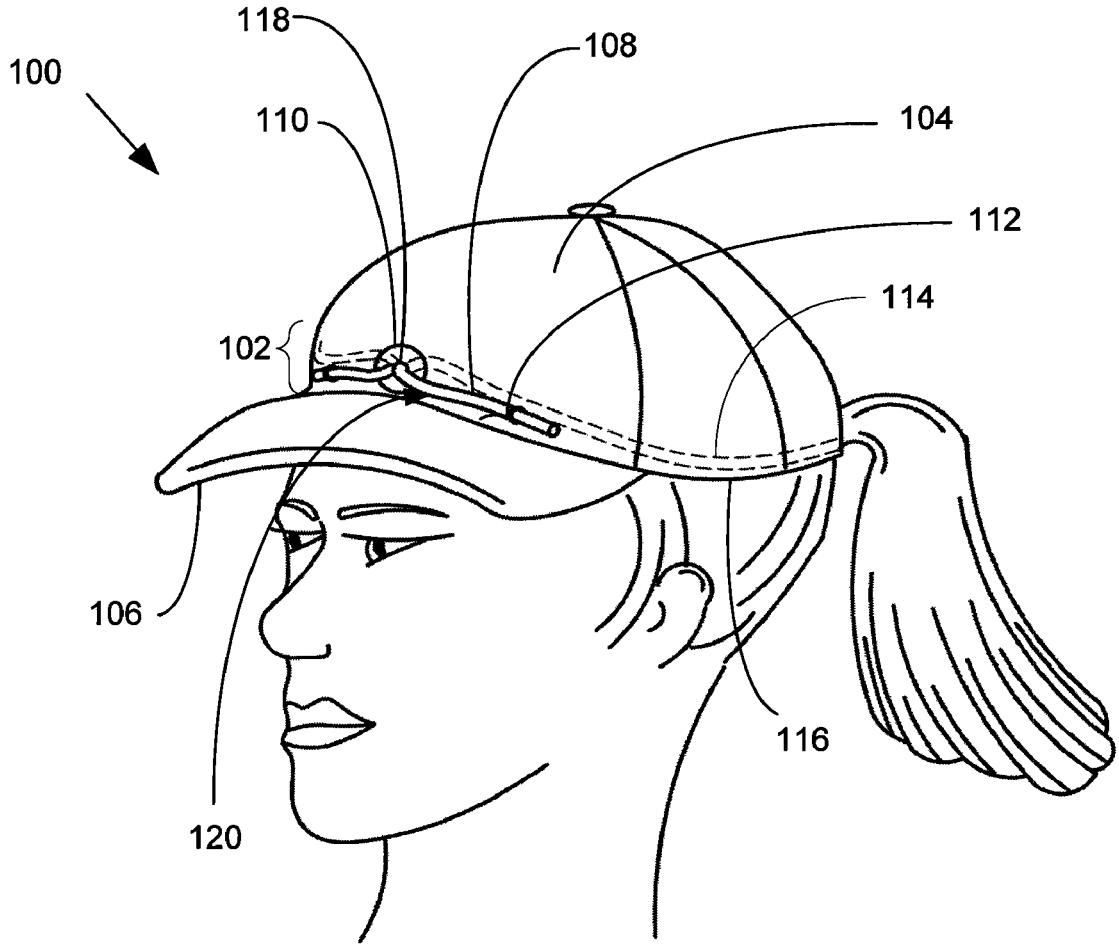
FIG. 1 is a perspective view of the headwear, according to one embodiment of the invention.

For a better understanding of the invention, reference should be made to the following detailed description taken in conjunction with the accompanying drawings, in which:

FIG. 1 is a perspective view of the headwear, according to one embodiment of the invention. The headwear 100 includes a lower crown 102, a crown 104, a brim 106, a cord 108, a cord fastener 110, a cord retention device 112, a passageway 114, a rim 116, an opening 118, and a tightening portion 120, most of which will be explained in further detail below. The headwear may be any type of hat, which includes, but is not limited to, conventional hats, baseball caps, visors, cowboy hats, fedoras, bonnets, sun-hats, rainhats, or the like. For illustration purposes only, the embodiment shown in FIGS. 1-6, the headwear 100 is a baseball cap.

As seen in FIGS. 1-6, the lower crown 102 encircles the lower base of the crown 104. In some embodiments, the lower crown 102 is made of a flexible material in order to allow the hat to be adjusted to fit snugly on a wearer's head.

In this embodiment, the cord 108 has two loose and opposed ends. The cord 108 passes through the passageway 114 and through the cord fastener 110, which secures the two ends of the cord 108. The cord 108 may be made from a flexible material such as strands of cotton, polyester, nylon, or the like. In some embodiments, the cord 108 may be made of several pieces of thread or yarn twisted together or any type of flexible string or ribbon. Alternatively, the cord 108 may be made from an elasticized material, such as multiple thin elastic bands combined within flexible cotton piping. The cord 108 has sufficient length to (i) surround the entire circumference of the lower crown 102, (ii) extend towards the rear to form an extended loop 300 that can twist around a wearer's ponytail, and (iii) extend at the front to form the tightening portion 120.

The cord 108 extends from the passageway 114 at an opening 118. The opening 118 is sized to allow the cord 108 to pass through. In some embodiments, the opening 118 is a slit in the fabric of the lower crown 102. Alternatively, the opening 118 can be a hole of any geometry, including for example, a circle, a diamond, a triangle, or an ellipse in the fabric of the lower crown 102.

In some embodiments, the passageway 114 is located near the rim 116 of the headwear 100. The passageway is of sufficient size for the cord 108 to be able to slide within it. In some embodiments, the width of the passageway 114 is substantially similar to that of the cord 108 so as to allow the cord to be laterally slidable, but to not allow the cord 108 to move around vertically within the passageway 114.

The cord fastener 110 may be any type of device that can securely couple two lengths of the cord 108 to one another. For example, the cord fastener 110 may be a bead with a hole through the middle or a slidable spring loaded clamping mechanism. In its simplest embodiment, the cord fastener 110 may be a knot or a bow that ties the loose ends of the cord 108 together. The cord fastener 110 is capable of sliding along the cord 108 near the tightening portion 120 of the cord 108 so it can be pulled away from or towards the lower crown 102. When the cord fastener 110 is pulled towards the lower crown 102, the diameter of the portion of the cord 108 that runs along the lower crown 102 decreases in size.

Figure 3:
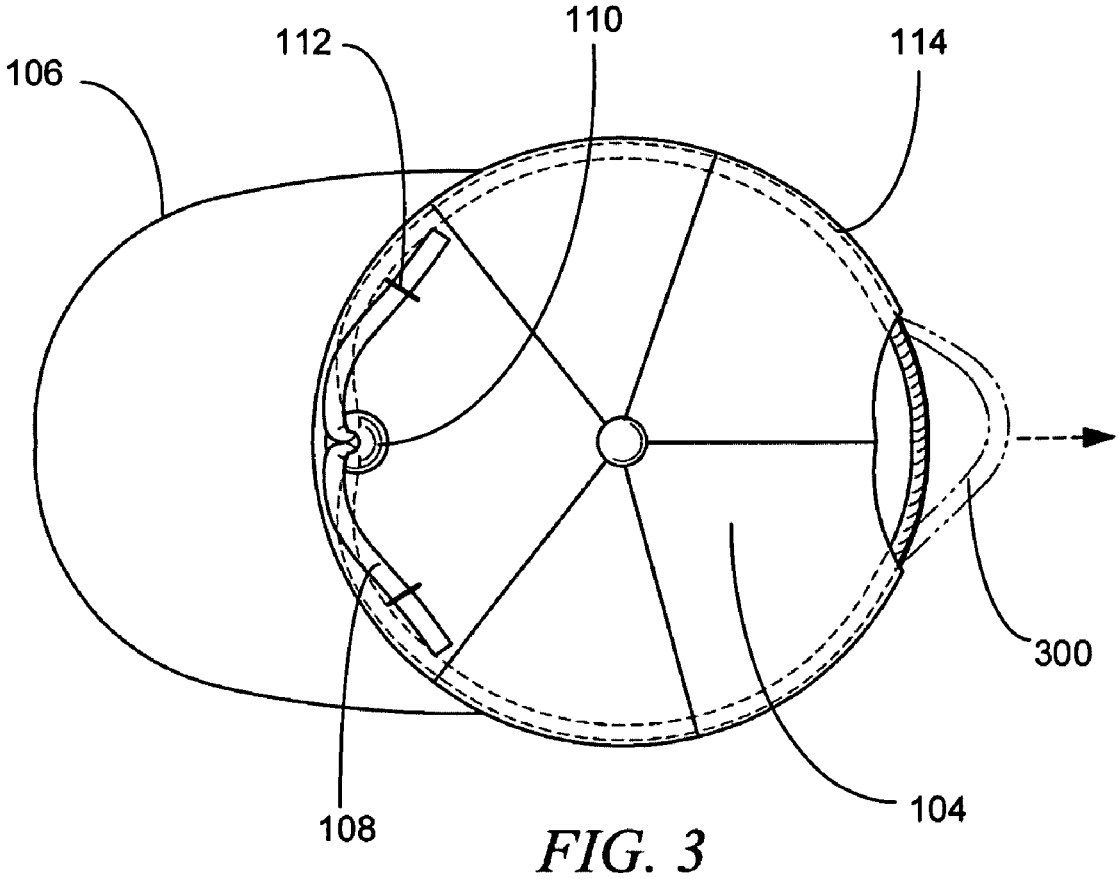
FIG. 3 is a top view of the headwear of FIG. 1.
Figure 4:
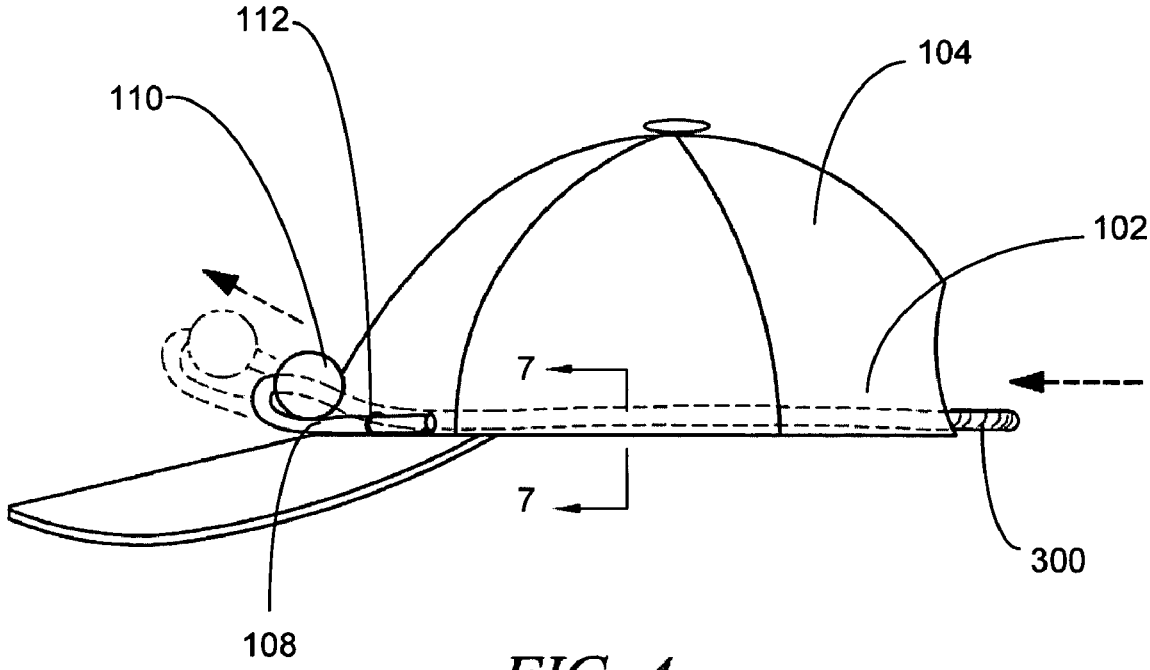
FIG. 4 is a side view of the headwear of FIG. 1.

In the embodiment shown in FIGS. 1, 3, and 4, the tightening portion 120 of the cord 108 is held in place by the cord retention device 112. The cord retention device 112 may be affixed to any part of the headwear, such as the brim 106, the crown 104, or the lower crown 102. The cord retention device 112 may be a loop for receiving and holding the loose ends of the cord 108 in place, as illustrated in FIG. 1. In some embodiments, the cord retention device 112 is a hook and loop fastener (VELCRO). In this case, one of the hook and loop fasteners is attached to the tightening portion 120 of the cord 108, while the other is attached to the headwear. In some embodiments, the cord retention device 112 is a press-stud, with one end of the snap affixed to the tightening portion 120 of the cord 108 and other corresponding snap affixed to the headwear. In other embodiments, the cord retention device is a built-in pocket in which tightening portion 120 can be inserted.

Figure 2:
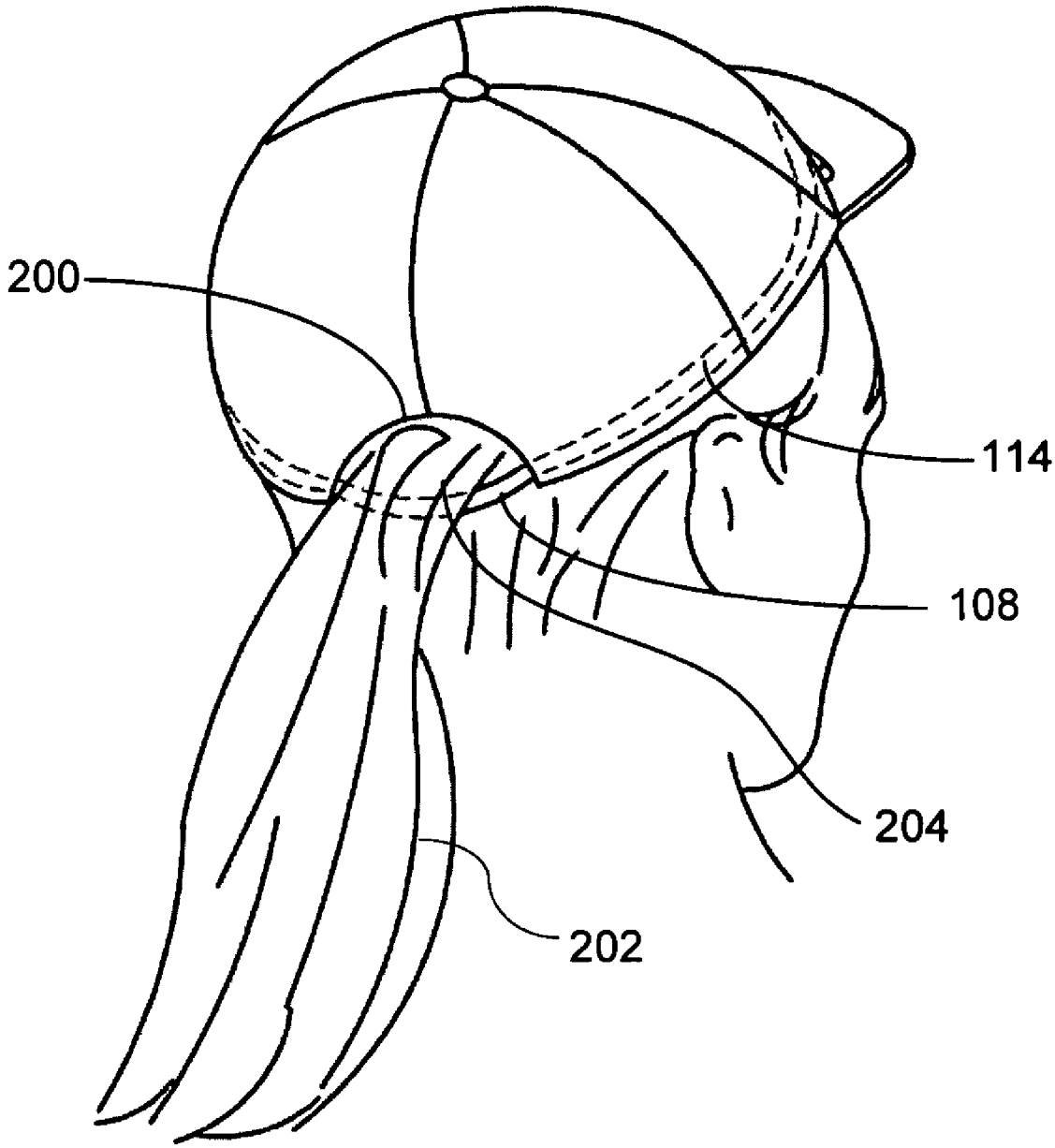
FIG. 2 is a rear perspective view of the headwear of FIG. 1.

FIG. 2 is a rear perspective view of the headwear of FIG. 1, which illustrates the position of the rear portion of the cord 108 in relation to a ponytail 202 of a wearer. A rear aperture 200 provides additional room for hair to pass though. A wearer can pull their hair towards the back of their head to form a ponytail 202 that passes through the rear aperture 200 and above the extended portion of the cord 108. When worn in this configuration, the wearer's ponytail is only confined by the size of the aperture.

The rear aperture 200 is preferably of sufficient size to allow the base 204 of a ponytail 202 to pass through. As illustrated in FIG. 2, the base of the rear aperture has an opening on either side to allow the cord 108 to pass through. The rear aperture 200 and the cord 108 therefore surround the base 204 of the ponytail 202.

FIG. 3 is a top view of the headwear of FIG. 1 that illustrates the capability of the cord 108 to extend to form an extended loop 300 for securing hair. The extended loop 300 is not attached to the lower crown 102. In some embodiments, the extended loop 300 is of sufficient length to twist around a wearer's ponytail at least once but may be extendable to twist around the ponytail 202 multiple times, as needed.

Figure 6:
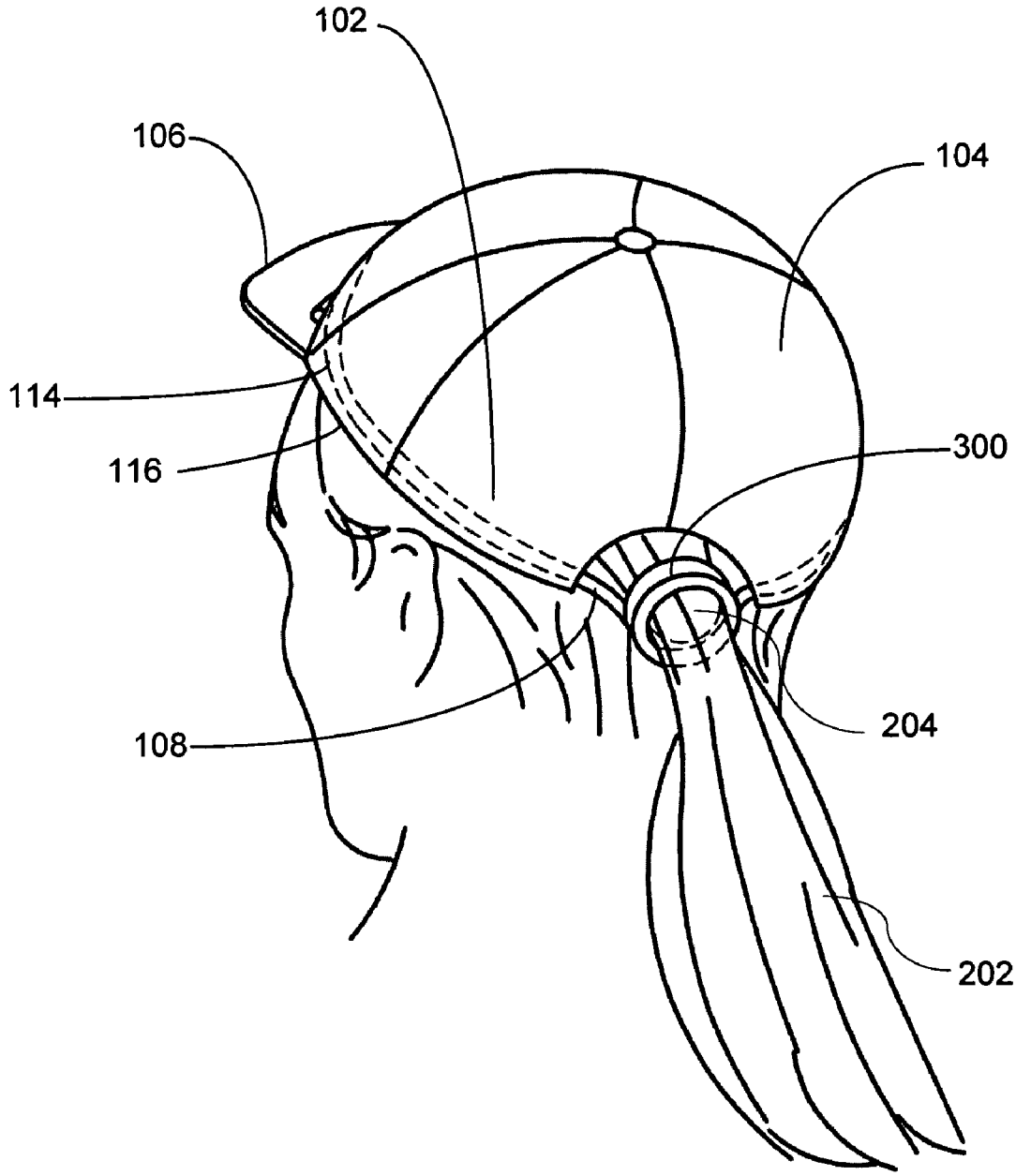
FIG. 6 is a rear perspective view of the headwear of FIG. 1.

FIG. 4 is a side view of the headwear of FIG. 1. This figure shows the cord 108 in tightened and untightened positions. As shown, the cord 108 may be pulled toward the front of the headwear 100, and the cord fastener 110 may be pulled toward the wearer's head, thereby pulling, tightening and reducing the entire circumference of the cord 108 and lower crown 102 around the wearer's head. Pulling the cord 108 towards the front of the headwear 100 shortens the length of the extended loop 300 and effectively provides for a more secure fit around the entire circumference of a wearer's head. Pulling the cord 108 towards the front of the headwear also acts to tighten the loop 300 around the base 204 of a ponytail 202, as shown in FIG. 2, 4, and 6. The fastening device 110 is then slid along the length of the cord 108 and clamped into position to adjust the fit of the headwear 100.

Figure 5:
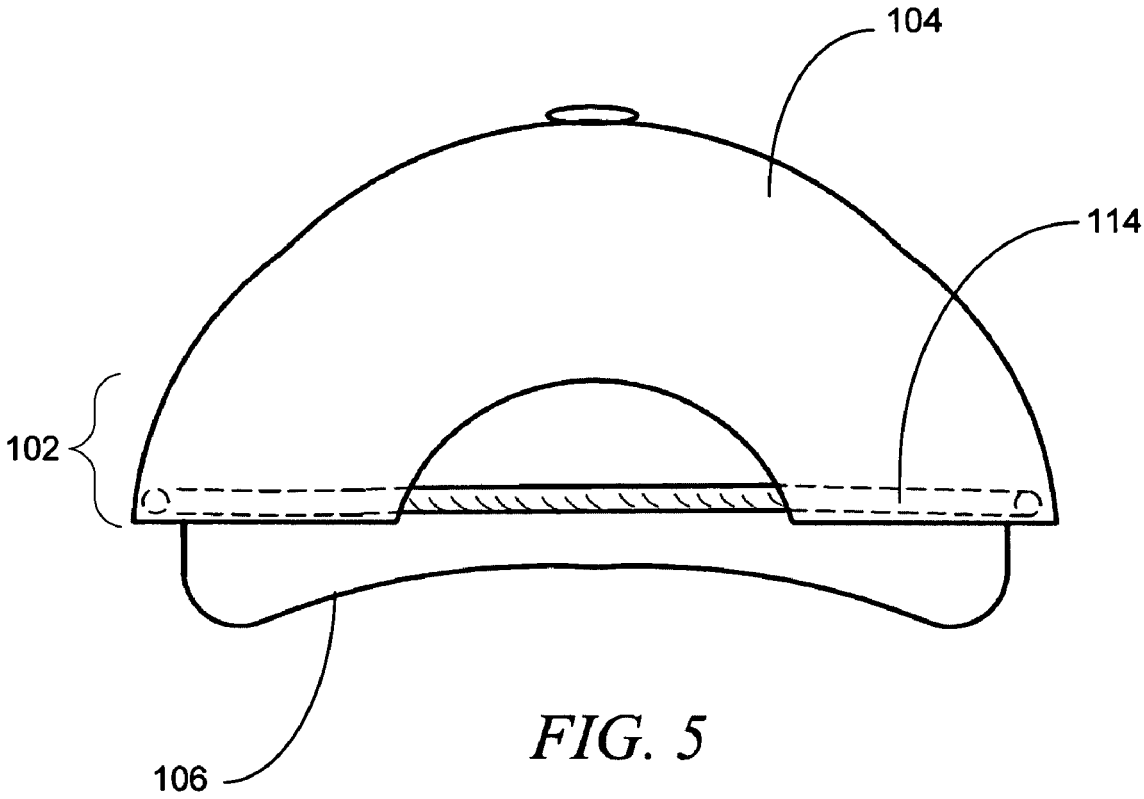
FIG. 5 is a rear view of the headwear of FIG. 1.

FIG. 5 is a rear view of the headwear of FIG. 1. This figure further illustrates the rear aperture 200 and the extended loop 300.

FIG. 6 is a rear perspective view of the headwear 100 of FIG. 1. When worn in this configuration, the cord securely wraps around a wearer's ponytail, for example, the extended loop 300 is twisted around the base 204 of ponytail 202. When the cord is tightened, the loop that is twisted around the wearer's ponytail is also tightened and pulled toward the wearer's head, thereby securing the wearer's hair into a tight ponytail.

Figure 7:
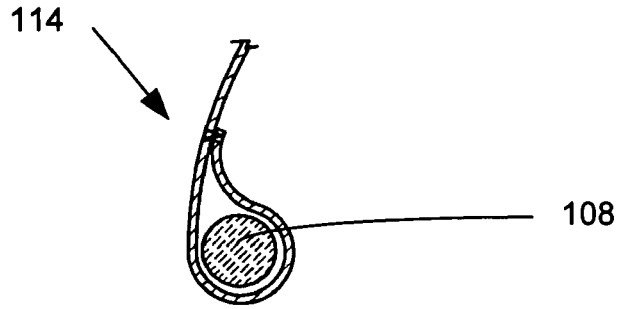
FIG. 7 is a cross-sectional view of the passageway of the headwear of FIG. 1.

FIG. 7 is a cross-sectional view of the passageway of the headwear of FIG. 1. The passageway 114 slidingly receives the cord 108 therein. In some embodiments, the passageway 114 is located within the fabric of the lower crown 102. However, in other embodiments, the passageway 114 is a separate component affixed to the exterior or interior part of the lower crown 102.

Figure 8:
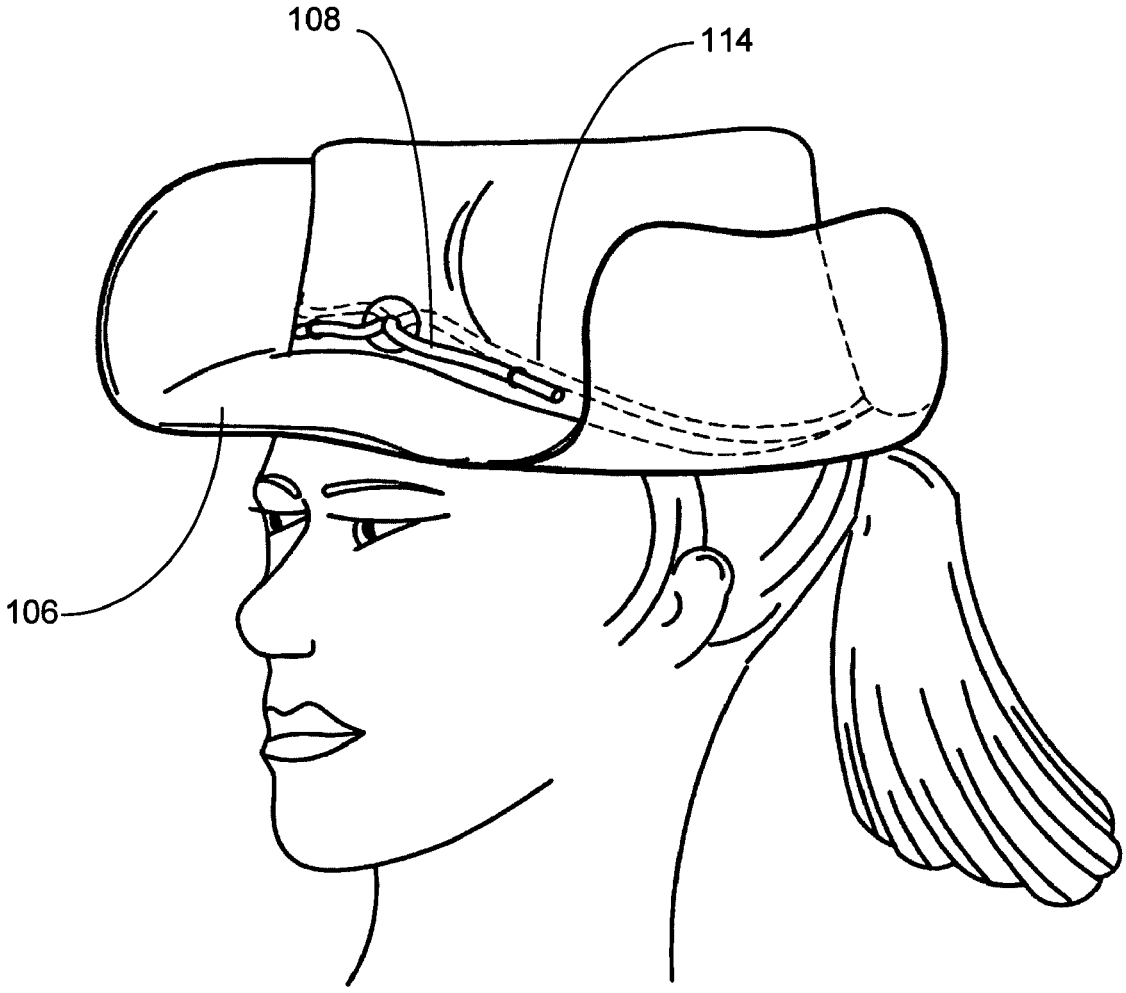
FIG. 8 is a perspective view of another headwear, according to another embodiment of the invention.

FIG. 8 is a perspective view of the headwear, according to another embodiment of the invention. In this embodiment, the headwear is a cowboy hat that employs the same mechanisms and techniques as described above. If the headwear is not made of flexible material, the passageway 114 or lower crown 102 may be a separate component located inside of and attached to the lower crown 102 to still allow the diameter of the lower crown to be adjusted and to allow a wearer's ponytail to be secured therein.

While the foregoing description and drawings represent the preferred embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, and with other elements, materials, and components, without departing from the spirit or essential characteristics thereof. The presently disclosed embodiments are therefore to be considered in all respects as illustrative and not restrictive, the scope of the invention being indicated by the appended claims, and not limited to the foregoing description.

What is claimed is:

1. Adjustable headwear, comprising:

a lower crown having a front side, an opposing back side, and an adjustable diameter; and a cord slidingly coupled along at least part of said lower crown, wherein said cord comprises:

a loop extended from said lower crown at the back side, wherein said loop is of sufficient length to wrap around a ponytail of a wearer; and a tightening portion extended from said lower crown at the front side, where said tightening portion is used to tighten said loop and reduce said diameter of said lower crown.

2. The headwear of claim 1, wherein said lower crown is configurable to contact at least a portion of a perimeter of a head of a wearer.

3. The headwear of claim 1, wherein said loop is of sufficient length to form at least one additional loop around the ponytail of the wearer.

4. The headwear of claim 1, wherein said cord is at least partly elasticized.

5. The headwear of claim 1, further comprising a passageway around said lower crown.

6. The headwear of claim 5, further comprising an opening at the front side of said lower crown of sufficient size to allow access for said cord to protrude out of said passageway.

7. The headwear of claim 5, wherein said passageway is internally located within said lower crown.

8. The headwear of claim 5, wherein said passageway is coupled along an interior of said lower crown.

9. The headwear of claim 5, wherein said passageway is coupled along an exterior of said lower crown.

10. The headwear of claim 1, wherein said cord has first and second ends that extend from said lower crown at the front side.

11. The headwear of claim 1, further comprising a fastening device coupled to said tightening portion of said cord.

12. The headwear of claim 11, wherein said fastening device is a bead with an opening there through for receiving said tightening portion of said cord.

13. The headwear of claim 11, wherein said fastening device is a slidable clamp.

14. The headwear of claim 1, further comprising a cord retention device for securing said tightening portion of said cord to said headwear.

15. The headwear of claim 1, further comprising a brim attached to at least a portion of said lower crown.

16. The headwear of claim 1, further comprising a baseball cap style brim attached to the front side of said lower crown.

17. Adjustable headwear, comprising:

a lower crown having a front side, an opposing back side, and an adjustable diameter;

a brim that runs along at least a portion of the front side of the lower crown; and a cord slidingly coupled along said lower crown and extendible to form a continuous loop of sufficient length to wrap around a ponytail of a wearer at the back side of the lower crown, wherein said cord is also extendible at the front side of the lower crown to tighten the loop and reduce said diameter of the lower crown;

a passageway around said lower crown of sufficient size to allow said cord to pass there through; and an opening at the front side of said lower crown of sufficient size to allow access to said cord.

18. A method of wearing headwear that includes a lower crown having a front side, an opposite back side, and a predetermined diameter, and a cord slidingly coupled along at least part of said lower crown, wherein said cord defines (i) a loop extended from said back side of the lower crown, and (ii) a tightening portion extended from said front side of the lower crown, said method comprising the steps of:

positioning said headwear on a head of said wearer;

twisting said loop around said ponytail of said wearer;

extending said cord at said front side of the lower crown to tighten said loop around said ponytail and reduce said diameter of said lower crown; and securing said tightening portion.

19. Adjustable headwear, comprising:

contact means for contacting a wearer's head, said means having a front side, an opposite back side, and a predetermined diameter; and adjusting means for sliding along at least part of said contact means, wherein said adjusting means comprises:

loop means for wrapping around a ponytail of a wearer, where said loop means for wrapping is extended from said back side of said contact means; and tightening means for tightening said loop means and reducing said diameter of said contact means, wherein said tightening means is extended from said front side of said contact means.

* * * * *

UNITED STATES PATENT AND TRADEMARK OFFICE

CERTIFICATE OF CORRECTION

PATENT NO. : 7,665,154 B2
APPLICATION NO. : 11/282344
DATED : February 23, 2010
INVENTOR(S) : Michele Gerstel Costello It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1105 days.

Signed and Sealed this

Seventh Day of December, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,665,154 B2
APPLICATION NO. : 11/282344
DATED : February 23, 2010
INVENTOR(S) : Michele Gerstel et al.

It is certified that error appears in the above-identified patent and that said Letters Patent is hereby corrected as shown below:

On the Title Page, Item (76) Inventor: Michele Gerstel Costello, please delete "Costello"

Signed and Sealed this
Fourteenth Day of October, 2014

Michelle K. Lee

Michelle K. Lee
*Deputy Director of the United States Patent and Trademark Office*